US009523947B2

(12) United States Patent
Cutts et al.

(10) Patent No.: US 9,523,947 B2
(45) Date of Patent: Dec. 20, 2016

(54) TIME-BASED COMMUTATION METHOD AND SYSTEM FOR CONTROLLING A FUSER ASSEMBLY

(71) Applicant: Lexmark International, Inc., Lexington, KY (US)

(72) Inventors: David Ross Cutts, Lexington, KY (US); Aaron Michael Lambert, Lexington, KY (US); Jason W Lawrence, Austin, TX (US); Kevin Dean Schoedinger, Lexington, KY (US); Ryan Matthew Smith, Lexington, KY (US); Christopher L. Yaeger, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 14/038,560

(22) Filed: Sep. 26, 2013

(65) Prior Publication Data

US 2014/0212161 A1 Jul. 31, 2014

Related U.S. Application Data

(60) Provisional application No. 61/705,847, filed on Sep. 26, 2012.

(51) Int. Cl.
*G03G 15/00* (2006.01)
*G03G 15/20* (2006.01)

(52) U.S. Cl.
CPC .. *G03G 15/2039* (2013.01); *G03G 2215/2035* (2013.01)

(58) Field of Classification Search
CPC ..... G03G 15/2039
USPC ..... 399/38, 71, 149, 299, 70
See application file for complete search history.

(56) References Cited

U.S. PATENT DOCUMENTS

| | | | |
|---|---|---|---|
| 3,483,679 | A | 12/1969 | Balbierer |
| 3,924,566 | A | 12/1975 | Dennie |
| 3,927,937 | A | 12/1975 | de Keyzer |
| 4,029,047 | A | 6/1977 | Bell |
| 4,030,824 | A | 6/1977 | Smith |
| 4,251,155 | A | 2/1981 | Schnall et al. |
| 4,281,918 | A | 8/1981 | Fortmann |
| 4,282,471 | A | 8/1981 | Budniak et al. |
| 4,353,016 | A | 10/1982 | Born |

(Continued)

FOREIGN PATENT DOCUMENTS

| | | | |
|---|---|---|---|
| JP | 04125640 | A * | 4/1992 |
| JP | 2000083392 | A | 3/2000 |
| JP | 2006285015 | A * | 10/2006 |

*Primary Examiner* — Quana M Grainger

(57) ABSTRACT

An imaging device includes a fuser assembly including a heat transfer member and a backup member positioned to engage the heat transfer member thereby defining a fusing nip therewith. A motor is coupled to the backup member for rotating the backup member. A controller coupled to the fuser assembly controls the motor using time-based commutation for a period of time to rotate the backup member at a slower speed relative to a speed for performing a toner fusing operation. In memory, at least one lookup table is stored having entries which, when sequentially accessed by the controller during the time-based commutation, are used to generate one or more drive signals for the motor to cause current flowing through windings of the motor to have a substantially sinusoidal waveform.

21 Claims, 8 Drawing Sheets

(56) References Cited

U.S. PATENT DOCUMENTS 4,436,413 A 3/1984 Oka
4,449,079 A * 5/1984 Erdman ..... 318/400.31
4,459,525 A 7/1984 Hasegawa
4,459,675 A 7/1984 Bateson et al.
4,517,503 A 5/1985 Lin et al.
4,530,594 A 7/1985 Adachi
4,591,774 A 5/1986 Ferris et al.
4,593,997 A 6/1986 Fox et al.
4,601,569 A 7/1986 Garris
4,623,827 A 11/1986 Ito
4,627,716 A 12/1986 Oka
4,630,653 A 12/1986 Kan
4,638,225 A 1/1987 Morinaga et al.
4,650,312 A 3/1987 Vineski
4,660,960 A 4/1987 Fukunaga et al.
4,689,540 A 8/1987 Tani et al.
4,711,561 A 12/1987 Tsuruoka
4,819,030 A 4/1989 Shibano
4,819,578 A 4/1989 Koiso et al.
4,849,791 A 7/1989 Hagihara et al.
4,870,449 A 9/1989 Brown
4,885,515 A 12/1989 Kurakake et al.
4,891,678 A 1/1990 Ishuzu et al.
4,941,022 A 7/1990 Ohmura et al.
4,958,196 A 9/1990 Fujii et al.
4,974,031 A 11/1990 Koiso et al.
4,982,231 A 1/1991 Matsuuchi
4,985,734 A 1/1991 Honda et al.
5,031,001 A 7/1991 Kusumoto
5,038,180 A 8/1991 Niki
5,089,761 A 2/1992 Nakazawa
5,113,227 A 5/1992 Miyasaka
5,128,724 A 7/1992 Hayashi et al.
5,130,756 A 7/1992 Taniyama
5,132,740 A 7/1992 Okamoto et al.
5,138,394 A 8/1992 Watanabe et al.
5,231,338 A * 7/1993 Bulgarelli et al. ..... 318/400.04
5,260,755 A 11/1993 Imaizumi
5,309,211 A 5/1994 Yoshioka
5,311,105 A * 5/1994 Nakai et al. ..... 318/400.32
5,341,199 A 8/1994 Thorp et al.
5,355,199 A 10/1994 Bray
5,367,234 A 11/1994 DiTucci
5,378,975 A 1/1995 Schweid et al.
5,383,578 A 1/1995 Nishimura
5,440,376 A 8/1995 Hagihara
5,444,522 A 8/1995 Owens, Jr.
5,486,747 A 1/1996 Welch
5,500,716 A 3/1996 Morishita et al.
5,534,988 A 7/1996 Gerbasi
5,541,714 A 7/1996 Watanabe et al.
5,585,894 A 12/1996 Araya et al.
5,594,541 A 1/1997 Bonislawski, Jr. et al.
2,625,264 A 4/1997 Yoon
5,625,269 A 4/1997 Ikeda
5,634,186 A 5/1997 Villalobos-Garcia et al.
5,663,624 A 9/1997 Callaway
5,708,952 A 1/1998 Taniguchi et al.
5,723,957 A 3/1998 Ishikawa
5,737,483 A 4/1998 Inaji et al.
5,783,917 A * 7/1998 Takekawa ..... 318/400.1
5,821,713 A * 10/1998 Holling et al. ..... 318/400.32
5,821,970 A 10/1998 Sasaki et al.
5,875,382 A 2/1999 Inoue
5,918,085 A 6/1999 Rollins et al.
5,923,931 A 7/1999 Kishimoto
5,933,690 A 8/1999 Sugimoto et al.
5,936,371 A 8/1999 Bolash et al.
5,937,235 A 8/1999 Huss et al.
5,952,798 A 9/1999 Jones et al.
5,963,006 A 10/1999 Otani
5,995,774 A 11/1999 Applegate et al.
6,014,541 A 1/2000 Kato et al.
6,091,216 A 7/2000 Takahashi et al.
6,107,763 A 8/2000 Rossi
6,154,619 A 11/2000 Boockholdt et al.
6,160,975 A 12/2000 Brantley
6,239,564 B1 * 5/2001 Boe et al. ..... 318/400.21
6,266,511 B1 7/2001 Murakami et al.
6,298,217 B1 10/2001 Murayama et al.
6,308,036 B1 10/2001 Taniyama et al.
6,438,321 B1 8/2002 Lin
6,505,127 B1 1/2003 Togami
6,534,948 B2 3/2003 Ohura et al.
6,628,096 B1 * 9/2003 Chen ..... 318/400.2
6,710,572 B2 3/2004 Okubo
6,828,752 B2 12/2004 Nakatsugawa et al.
6,901,212 B2 5/2005 Masino
6,933,690 B2 8/2005 Yamamoto
7,155,141 B2 * 12/2006 Sato et al. ..... 399/114
7,187,460 B2 3/2007 Able et al.
7,205,738 B2 4/2007 Chapman et al.
7,209,273 B2 4/2007 Sobue
7,274,163 B1 * 9/2007 Lambert et al. ..... 318/400.12
8,836,747 B2 9/2014 Harris et al.
2003/0044192 A1 3/2003 Brown et al.
2005/0281568 A1 12/2005 Hashizume
2009/0190941 A1 * 7/2009 Hashimoto et al. ..... 399/43
2012/0114356 A1 * 5/2012 Asaoka et al. ..... 399/68
2014/0105628 A1 * 4/2014 Cao et al. ..... 399/69

* cited by examiner

TIME-BASED COMMUTATION METHOD AND SYSTEM FOR CONTROLLING A FUSER ASSEMBLY

CROSS REFERENCES TO RELATED APPLICATIONS

Pursuant to 35 U.S.C. §119, this application claims the benefit of the earlier filing date of Provisional Application Ser. No. 61/705,847, filed Sep. 26, 2012, entitled "A Method and System for Controlling a Fuser Assembly," the contents of which are hereby incorporated by reference herein in their entirety. The present application is related to U.S. patent application Ser. No. 13/651,502, filed Oct. 15, 2012, entitled "Method and System for Controlling a Fuser Assembly," and U.S. Pat. Nos. 7,205,738 and 7,274,163, all assigned to Lexmark International, Inc., the contents of which are hereby incorporated by reference herein in their entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to controlling a fuser assembly in an electrophotographic imaging device, such as a laser printer or multifunction device having printing capability, and particularly to maintaining sufficient energy levels within a fuser assembly for a period of time when not performing a fusing operation so as to allow for a relatively short time to reach fusing temperatures without substantially increasing overall energy usage by the imaging device.

2. Description of the Related Art

In electrophotography, a latent image is created on an electrostatically charged photoconductive surface by exposing select portions of the surface to laser light. Essentially, the density of the electrostatic charge on the photoconductive surface is altered in areas exposed to a laser beam relative to those areas unexposed to the laser beam. The latent electrostatic image thus created is developed into a visible image by exposing the photoconductive surface to toner, which contains pigment components and thermoplastic components. When so exposed, the toner is attracted to the photoconductive surface in a manner that corresponds to the electrostatic density altered by the laser beam. The toner pattern is subsequently transferred from the photoconductive surface to the surface of a print substrate, such as paper, which has been given an electrostatic charge opposite that of the toner. The substrate then passes through a fuser assembly that applies heat and pressure thereto. The applied heat causes constituents including the thermoplastic components of the toner to flow into the interstices between the fibers of the medium and the pressure promotes settling of the toner constituents in these voids. As the toner subsequently cools, it solidifies thus adhering the image to the substrate.

Manufacturers of printing devices are continuingly challenged to improve printing device performance. One way in which improvement is sought is with respect to achieving a shorter time to printing a first media sheet of a print job (hereinafter "first print time"). To deliver improved first print times, one approach is for electrophotographic printers to keep its fuser assembly heated at a relatively warm temperature less than a temperature for fusing toner when the fuser assembly is not performing a fusing operation. Typically, a heat transfer member of the fuser assembly is heated to this relatively warm temperature. Although such approaches have been met with some success, there is a need for a printing device providing improved printing performance.

SUMMARY

Example embodiments overcome shortcomings of existing laser printing devices and thereby satisfy a significant need for controlling a fuser assembly to yield a reduced first print time in a relatively energy efficient manner. An example embodiment includes slowly rotating a backup roll that engages the heat transfer member while heating the heat transfer member during the period of time when toner fusing does not occur. Slowly rotating the backup roll while heating the transfer member may ensure that the backup roll stores an acceptable amount of energy to allow the fuser assembly to quickly reach a state for fusing toner to media sheets. Accordingly, an imaging device includes a fuser assembly including a heat transfer member and a backup member positioned to engage the heat transfer member thereby defining a fusing nip therewith. A motor is coupled to the backup member for rotating the backup member. A controller coupled to the fuser assembly controls the motor using time-based commutation for a period of time to rotate the backup member at a slower speed relative to a speed for performing a toner fusing operation. In memory, at least one lookup table is stored having entries which, when sequentially accessed by the controller during the time-based commutation, are used to generate one or more drive signals for the motor to cause current flowing through windings of the motor to have a substantially sinusoidal waveform.

In another example embodiment, a motor control circuit for controlling a brushless dc motor includes a controller coupled to the motor for controlling the motor using time-based commutation based on a stored commutation table having entries that define extrapolated motor positions. A sensing arrangement, which is associated with the motor and coupled to the controller, senses motor position and provide the sensed motor position to the controller. The controller compares the sensed motor position with an expected motor position determined based on the stored commutation table in order to detect a stall condition of the motor during the time-based commutation.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
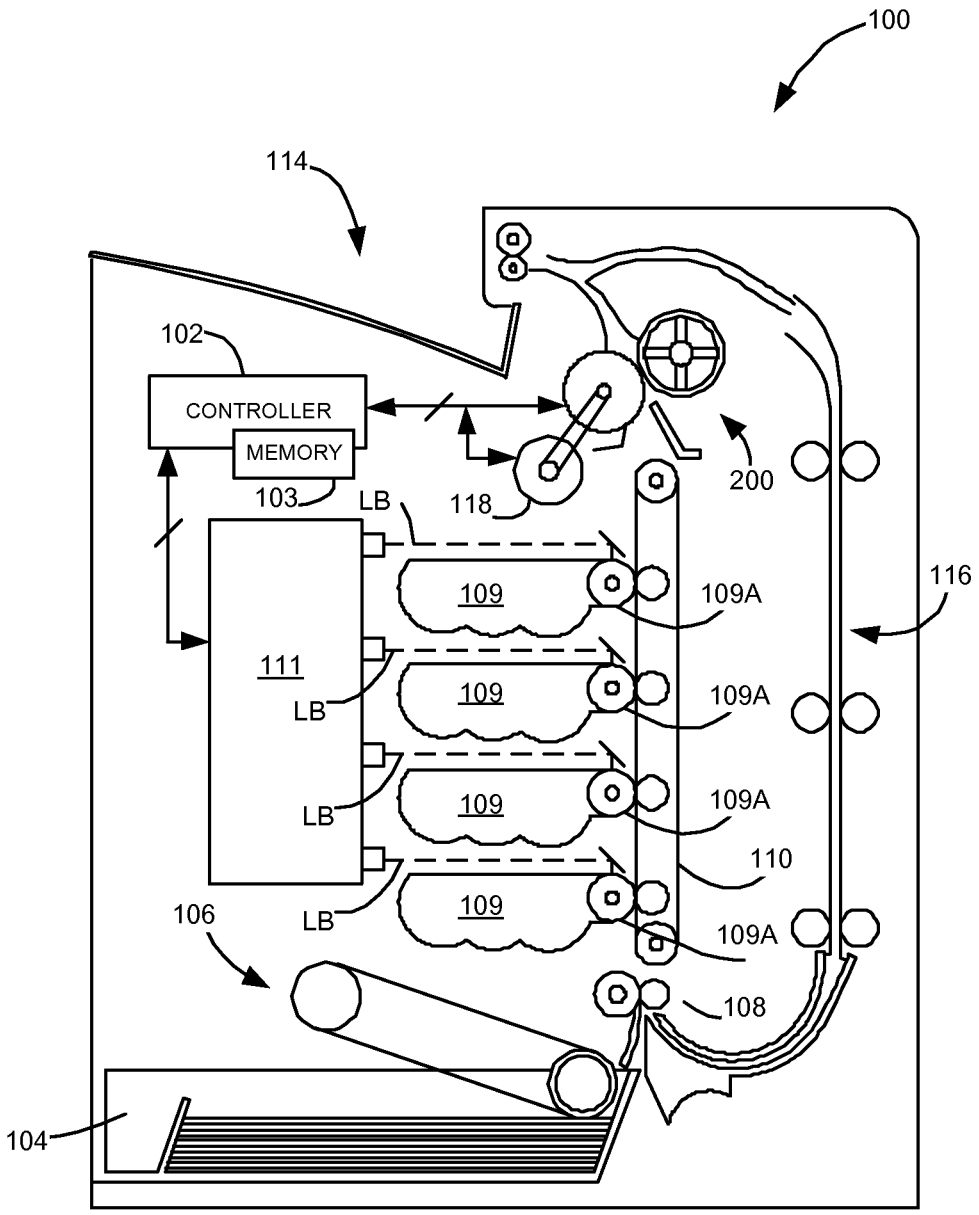
FIG. 1 is a side view of an imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Commutation is understood to refer to an arrangement of current through the motor. Commutation changes the flow of current in the motor windings to make the motor permanent magnets mechanically move in response to the magnetic field created by the electric current in the motor windings.

Feedback based commutation (FBC) refers to changing the commutation based on positional feedback from sensors, such as the state of three Hall sensors and/or signals from a Field Generation (FG) sensor.

An FG sensor refers to a sensor that uses motion to generate a voltage signal using Faraday's law.

Time based commutation (TBC) refers to changing the commutation based on the passage of time.

Sinusoidal commutation refers to current in the motor windings forming a sinusoidal waveform or substantially sinusoidal waveform.

Trapezoidal commutation refers to the sequential application of PWM modulated or analog DC voltages to each of the three motor windings in six states separated by 60 electrical degrees resulting in the current in the motor winding forming a waveform substantially resembling a trapezoidal shape.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

Referring now to the drawings and particularly to FIG. 1, there is shown an imaging device in the form of a color laser printer, which is indicated generally by the reference numeral 100. An image to be printed is typically electronically transmitted to a processor or controller 102 by an external device (not shown) or the image may be stored in a memory 103 embedded in or associated with the controller 102. Memory 103 may be any volatile and/or non-volatile memory such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may include one or more processors and/or other logic necessary to control the functions involved in electrophotographic imaging.

In performing a print operation, controller 102 initiates an imaging operation in which a top media sheet of a stack of media is picked up from a media or storage tray 104 by a pick mechanism 106 and is delivered to a media transport apparatus including a pair of aligning rollers 108 and a media transport belt 110 in the illustrated embodiment. The media transport belt 110 carries the media sheet along a media path past four image forming stations 109 which apply toner to the media sheet through cooperation with laser scan unit 111. Each imaging forming station 109 provides toner forming a distinct color image plane to the media sheet. Laser scan unit 111 emits modulated light beams LB, each of which forms a latent image on a photoconductive surface or drum 109A of the corresponding image forming station 109 based upon the bitmap image data of the corresponding color plane. The operation of laser scan units and imaging forming stations is known in the art such that a detailed description of their operation will not be provided for reasons of expediency.

Fuser assembly 200 is disposed downstream of image forming stations 109 and receives from media transport belt 110 media sheets with the unfused toner images superposed thereon. In general terms, fuser assembly 200 applies heat and pressure to the media sheets in order to fuse toner thereto. After leaving fuser assembly 200, a media sheet is either deposited into output media area 114 or enters duplex media path 116 for transport to the most upstream image forming station 109 for imaging on a second surface of the media sheet.

Imaging device 100 is depicted in FIG. 1 as a color laser printer in which toner is transferred to a media sheet in a single transfer step. Alternatively, imaging device 100 may be a color laser printer in which toner is transferred to a media sheet in a two step process—from image forming stations 109 to an intermediate transfer member in a first step and from the intermediate transfer member to the media sheet in a second step. In another alternative embodiment, imaging device 100 may be a monochrome laser printer which utilizes only a single image forming station 109 for depositing black toner to media sheets. Further, imaging device 100 may be part of a multi-function product having, among other things, an image scanner for scanning printed sheets.

Figure 2:
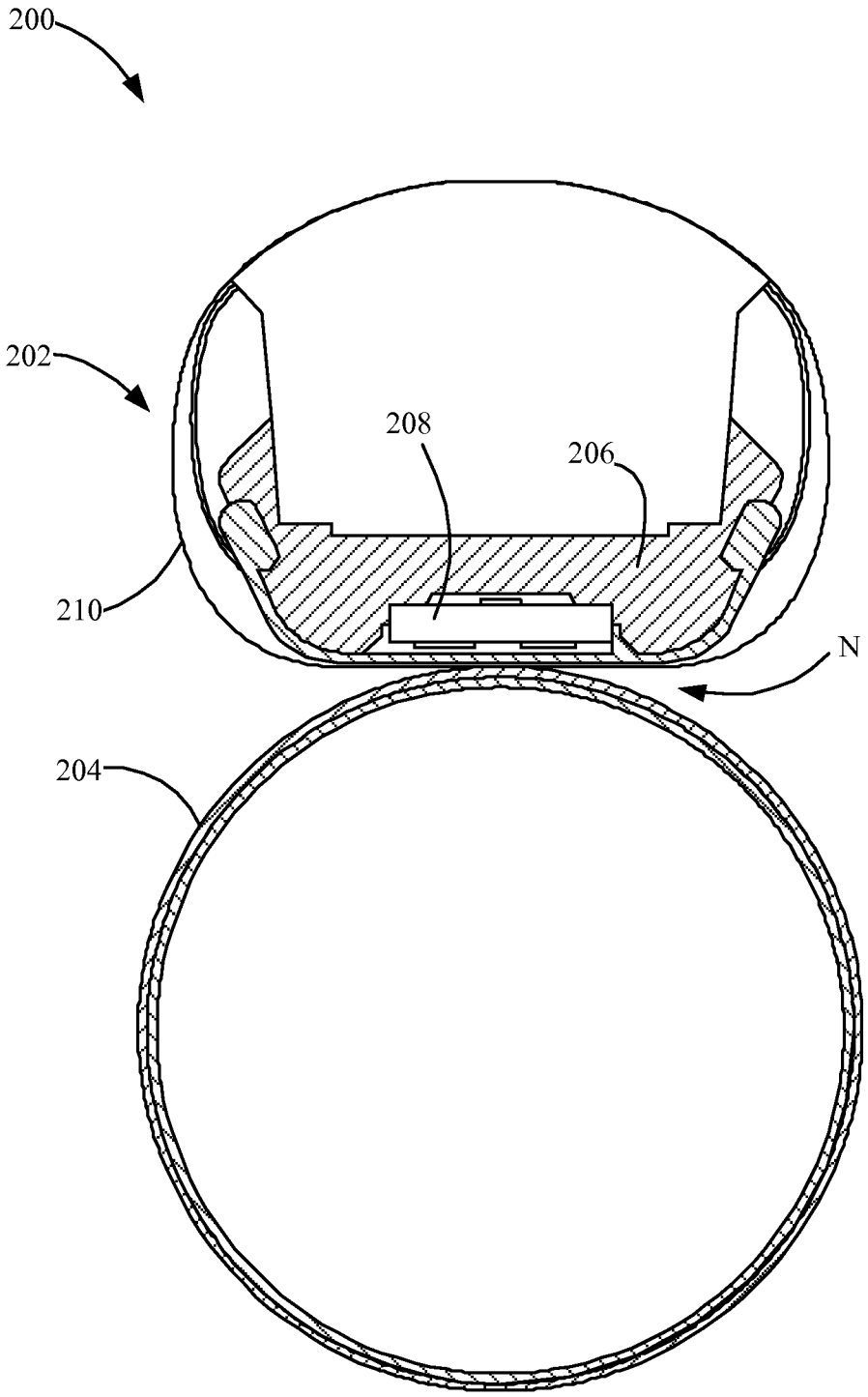
FIG. 2 is a cross sectional view of a fuser assembly of FIG. 1.

With respect to FIG. 2, fuser assembly 200 may include a heat transfer member 202 and a backup roll 204 cooperating with the heat transfer member 202 to define a fuser nip N for conveying media sheets therein. The heat transfer member 202 may include a housing 206, a heater element 208 supported on or at least partially in housing 206, and an endless flexible fuser belt 210 positioned about housing 206. Heater element 208 may be formed from a substrate of ceramic or like material to which one or more resistive traces is secured which generates heat when a current is passed through the resistive traces. Heater element 208 may further include at least one temperature sensor, such as a thermistor, coupled to the substrate for detecting a temperature of heater element 208. It is understood that heater element 208 alternatively may be implemented using other heat generating mechanisms.

Fuser belt 210 is disposed around housing 206 and heater element 208. Backup roll 204 contacts fuser belt 210 such that fuser belt 210 rotates about housing 206 and heater element 208 in response to backup roll 204 rotating. With fuser belt 210 rotating around housing 206 and heater element 208, the inner surface of fuser belt 210 contacts heater element 208 so as to heat fuser belt 210 to a temperature sufficient to perform a fusing operation to fuse toner to sheets of media.

Heat transfer member 202 and backup roll 204 may be constructed from the elements and in the manner as disclosed in U.S. Pat. No. 7,235,761, the content of which is incorporated by reference herein in its entirety. It is understood, though, that fuser assembly 200 may have a different architecture than a fuser belt based architecture. For example, fuser assembly 200 may be a hot roll fuser, including a heated roll and a backup roll engaged therewith to form a fuser nip through which media sheets traverse.

Figure 3:
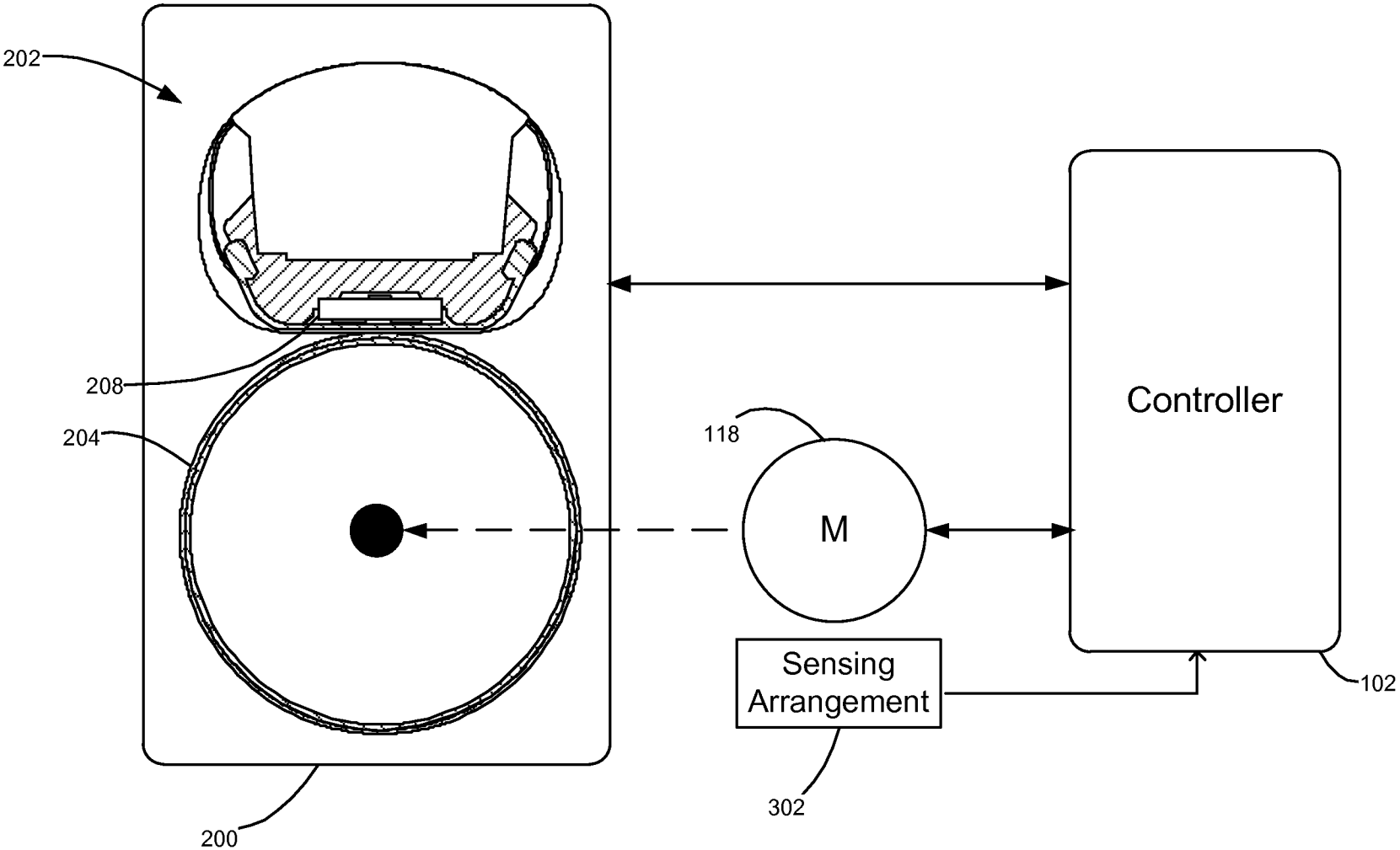
FIG. 3 is a block diagram illustrating electrical and mechanical coupling between components of the imaging device of FIG. 1.

Backup roll 204 may be driven by motor 118 (FIG. 1). Motor 118 may be any of a number of different types of motors. For instance, motor 118 may be a brushless D.C. motor (BLDC) or a stepper motor. Motor 118 may be coupled to backup roll 204 by any of a number of mechanical coupling mechanisms, including but not limited to a gear train (not shown). For simplicity, FIG. 3 represents the mechanical coupling between motor 118 and backup roll 204 as a dashed line. FIG. 3 also illustrates the communication between controller 102, motor 118 and fuser assembly 200. In particular, controller 102 generates control signals for controlling the movement of motor 118 and the temperature of heater element 208. Controller 102 may control motor 118 and heater element 208 during a fusing operation, for example, based in part upon feedback signals provided thereby. Fuser assembly 200 may further include a sensing arrangement 302 for sensing a position of motor 118 and communicating same to controller 102. The sensing arrangement 302 may include, for example, one or more Hall sensors for detecting motor position or an FG winding for detecting motion and/or speed of motor 118. It is understood that additional circuitry may be disposed between controller 102, motor 118 and fuser assembly 200, including but not limited to driver circuitry for suitably conditioning control signals for driving motor 118 and heating heater element 208.

Figure 4:
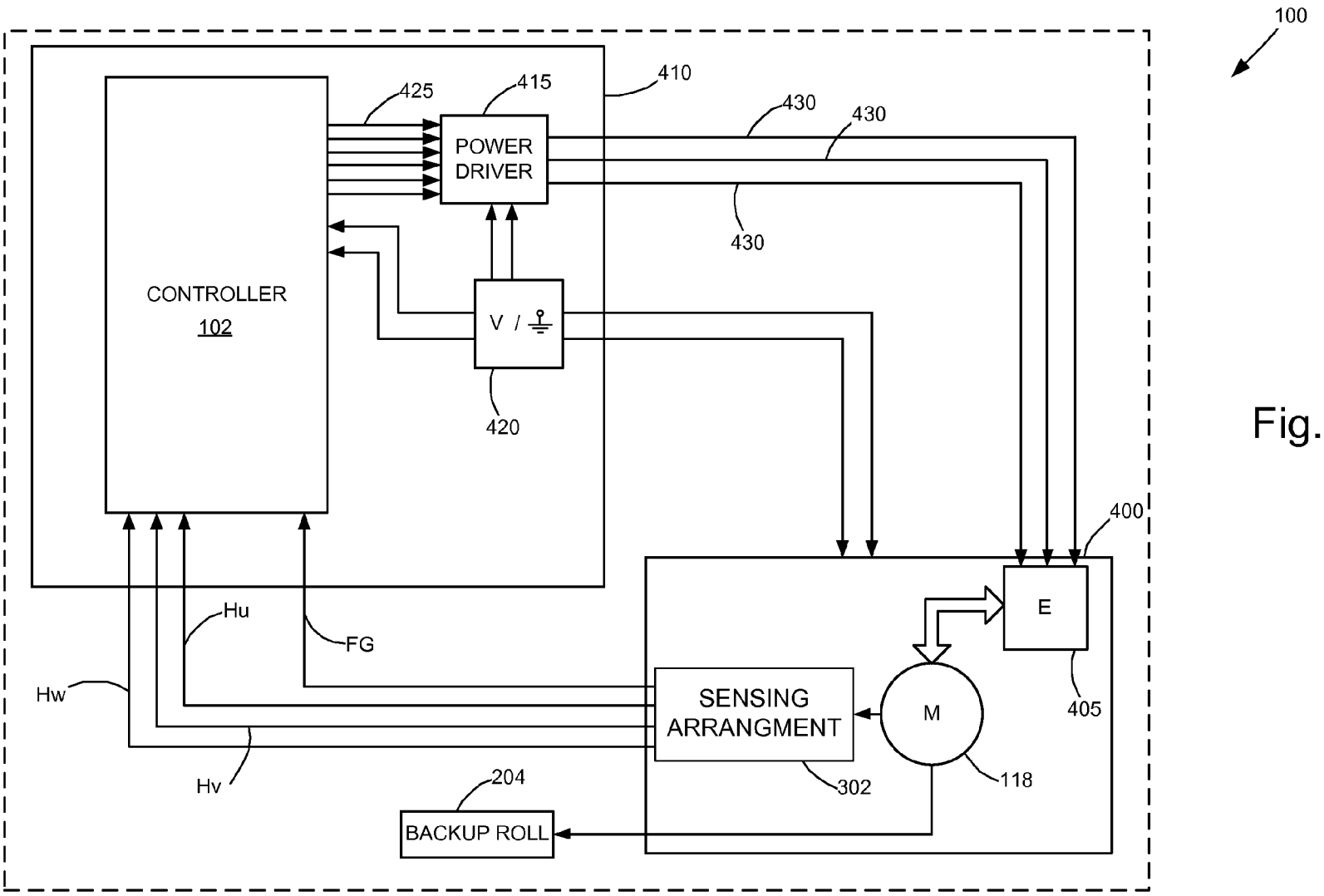
FIG. 4 is a block diagram illustrating of control system for controlling the motor of FIG. 3 according to an example embodiment.

FIG. 4 illustrates an example control system within imaging device 100 for controlling motor 118 according to one example embodiment. As shown, a motor assembly 400 incorporates motor 118, sensing arrangement 302, and attendant electronics 405. An engine card 410 may include controller 102, a power driver 415, and a voltage/ground source 420 for powering and grounding controller 102, power driver 415, and motor assembly 400. Engine card 410 may further include other circuitries such as counters, timers, and pulse width modulation (PWM) hardware as needed. Controller 102 may be coupled to outputs of sensing arrangement 302 which may include signals $H_U$, $H_V$, and $H_W$ from Hall sensors, and an FG signal from an FG sensor. Using these signals, controller 102 may create output signals 425 serving as inputs to power driver 415 which in turn creates drive signals 430. Drive signals 430 are coupled to attendant electronics 405 of motor assembly 400 and used thereby to rotate motor 118.

First print time is a performance based characteristic associated with imaging devices and, as a result, fuser assemblies. Because fuser assemblies need time in order to be heated to a fusing temperature prior to performing a fusing operation, the heating performance of a fuser assembly is often a contributing factor in an imaging device achieving an acceptable first print time. To be able to meet small first print times while providing acceptable levels of toner fusing, a sufficient amount of thermal energy may be stored in fuser assembly 200 prior to a media sheet reaching fuser nip N of the fuser assembly. Controller 102 generally controls fuser assembly 200 during times when fuser assembly 200 is not performing a fusing operation so as to maintain a sufficient amount of thermal energy in backup roll 204 and enable the temperature in fuser nip N of fuser assembly 200 to quickly reach fusing temperatures. This time may be seen as a standby mode for imaging device 100 and/or fuser assembly 200.

According to an example embodiment, when in a standby mode controller 102 activates heater element 208 to heat to a predetermined temperature while controller 102 controls motor 118 to cause backup roll 204 to relatively slowly rotate. By heating fuser assembly 200 while slowly rotating backup roll 204 during periods when fuser assembly is not performing a fusing operation, a sufficient amount of thermal energy is maintained generally uniformly throughout backup roll 204 such that the first print time is substantially reduced.

Figure 5:
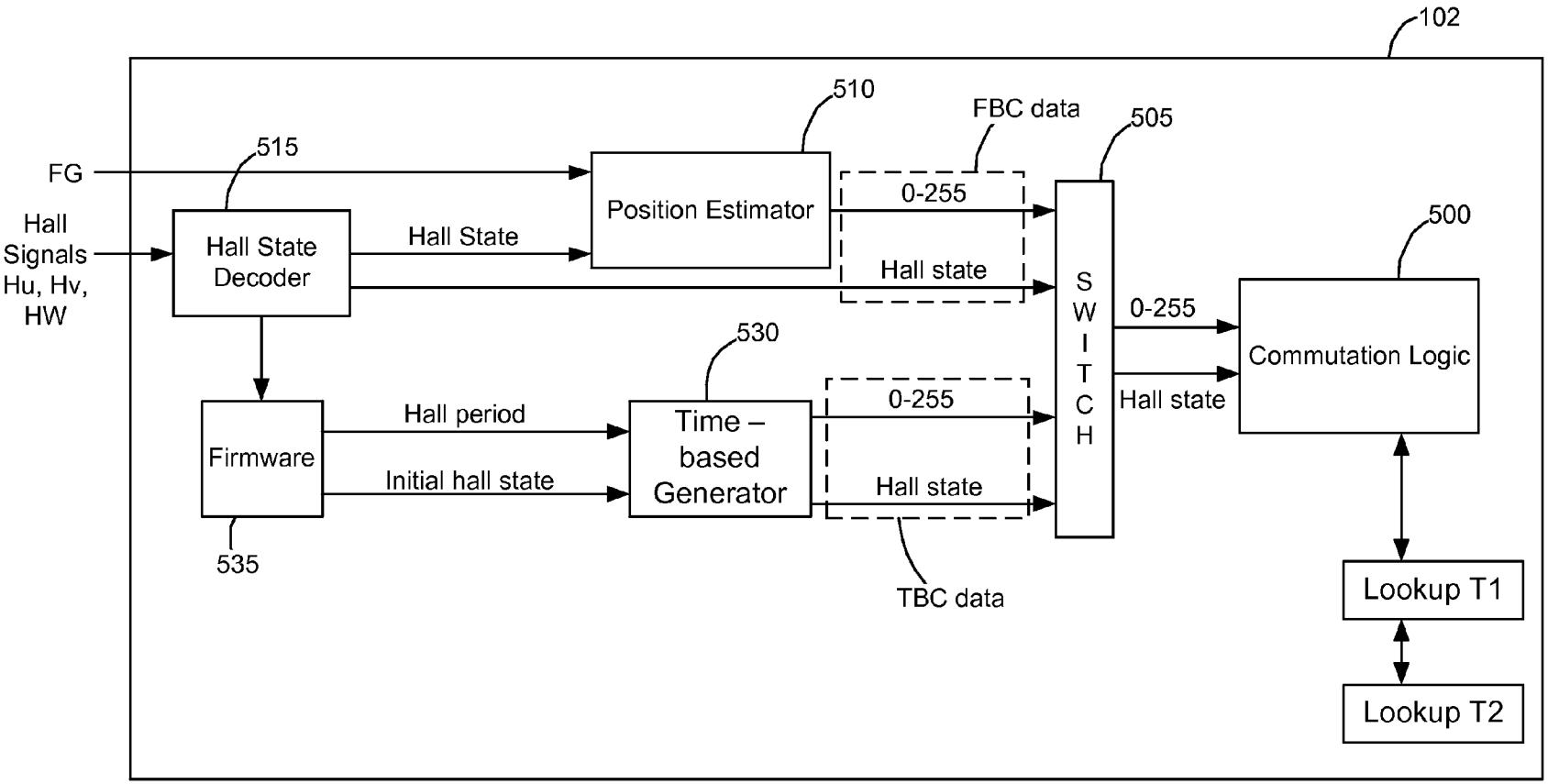
FIG. 5 is a block diagram showing at least a portion of the controller of FIG. 4 according to an example embodiment.

In an example embodiment, controller 102 may be associated with and/or include circuitry that allows switching of control of motor 118 between different modes of commutation. For example, as shown in FIG. 5, controller 102 may include a commutation logic block 500 and a switch block 505 for switching control of motor 118 between using TBC and FBC. In an example embodiment, imaging device 100 may switch control to using FBC when motor 118 is rotated at fusing speeds for performing a fusing operation based in part by use of motor speed and/or position information sensed and provided by sensing arrangement 302 to controller 102. On the other hand, imaging device 100 may utilize TBC for relatively slowly rotating motor 118 during times when fuser assembly 200 is not performing a fusing operation. A selection input for switch block 505 may be set by firmware executed by controller 102 to either TBC mode or FBC mode.

With further reference to FIG. 5, commutation logic block 500 may utilize one or more lookup tables T1, T2, with each addressable location in a lookup table maintaining a motor drive value corresponding to a discrete position of motor 118 when utilizing TBC. The motor drive values in a given lookup table may be used in generating the drive signals 430 for motor 118 for a single commutation cycle thereof. In particular, the lookup table may include values which, when sequentially addressed, generate the drive signals 430 for the windings of the motor 118 at the desired speed. The values in the lookup table may modulate the PWM drive signal(s) with a predefined waveform to achieve a sinusoidal or substantially sinusoidal shaped current or voltage in the motor's windings when utilizing TBC.

Commutation logic block 500 may accept two inputs from switch block 505: (1) Hall state data and (2) counter values that may range from 0 to 255, for example. Depending on the particular commutation approach to be used, controller 102 may control switch block 505 to supply appropriate Hall state data and counter value inputs to commutation logic block 500.

For example, when in FBC mode, switch block 505 may provide input to commutation logic block 500 based on outputs from a Position Estimator Block 510 and a Hall-sensor based logic (Hall State Decoder Block) 515. Hall State Decoder Block 515 may receive the Hall signals $H_U$, $H_V$, and $H_W$ from the Hall sensors associated with motor 118 and decode them to provide Hall states, indicating motor positions of motor 118, to switch block 505 and Position Estimator Block 510. The Hall states provided directly by Hall State Decoder Block 515 to switch block 505 may be used for trapezoidal FBC. Position Estimator Block 510 may also receive the FG signals from the FG sensor associated with motor 118 and use such signals, together with received Hall states from Hall State Decoder Block 515, to generate discrete counter values (0-255) used for sinusoidal FBC as described in U.S. Pat. No. 7,274,163. Accordingly, data from Position Estimator Block 510 and Hall State Decoder Block 515 may constitute FBC data provided by switch block 505 to commutation logic block 500 when in FBC mode. The FBC data is used by commutation logic block 500 to address values in at least one lookup table T1, T2 stored in memory in order to generate the drive signals 430 for motor 118 during an FBC mode of operation.

For TBC motor control, TBC data including Hall state data and counter values from a Time-Based Generator 530 are used by commutation logic block 500. Time-Based Generator 530 may be coupled to a firmware block 535. Firmware block 535, which may be part of the functionality performed by controller 102, may have access to actual positions of the Hall sensors associated with motor 118 via its connection with Hall State Decoder Block 515. Using actual Hall states from Hall State Decoder Block 515, firmware block 535 may determine an initial time-based Hall state at the start of TBC and provide the initial state to Time-Based Generator 530. The initial time-based Hall state may correspond to a current position of motor 118 as sensed by sensing arrangement 302. Firmware block 535 may also to provide a hall period to Time-Based Generator 530. The hall period may be a predetermined period representing a desired time-based hall period for motor 118. This period may set how quickly Time-Based Generator 530 steps through its time-based Hall generation cycle which dictates the actual speed of motor 118 while in TBC mode. This hall period, and hence the speed of motor 118, may be set independently of a feedback signal from the sensing arrangement 302. Alternatively, the hall period may be connected with or derived from a signal from the sensing arrangement 302 or the firmware block 535.

Time-Based Generator 530 may generate the appropriate Hall state data and counter values for use in TBC. The counter values from 0-255, for example, are used for sinusoidal TBC control in which the motor windings waveform substantially forms a sinusoid. As an example, controller 102 may receive a clock input (not shown) which can be divided down, and feed the clock input of counter circuitry (not shown) which may be provided within Time-Based Generator 530. The counter circuitry may increment a counter value based on the clock input. When the counter value matches a set value, commutation logic block 500 associated with controller 102 may be configured to access or read a new row or entry in lookup table T1. The new entry in the commutation table may change the PWM duty cycle between the three motor windings to create the sinusoidal current waveform therein. Accordingly, counter values 0-255 generated by Time-Based Generator 530 may correspond to addresses or entries in lookup table T1 that are sequentially accessed for generating signals resulting in a sinusoidal waveform appearing in the motor windings of motor 118. In an example embodiment, a starting entry in the lookup table T1 which is first accessed during sinusoidal TBC may be selected based on the initial Hall state determined by firmware block 535.

Accordingly, slow rotation of backup roll 204 may be accomplished by controlling the motor 118 to rotate backup roll 204 using TBC in an open loop manner which does not require positional feedback.

The Hall state data of TBC data, which may have six possible values (0, 1, 2, 3 4, 5), may be used by commutation logic block 500 for trapezoidal TBC as described in U.S. Pat. No. 7,205,738 in which the motor windings waveform substantially forms a trapezoid. In this regard, a second lookup table T2 may correspond to the time-based commutation described in such patent. The Hall state data may start at the initial Hall state set by firmware block 535, and may increment at the hall period set by firmware block 535.

In the above example embodiment, commutation logic block 500 may perform its function without having to know the particular commutation approach used. Instead, a selection input for switch block 505 may be set by firmware executed by controller 102 to select either TBC control or FBC control. When TBC control is selected, both the Hall state and the counter values 0-255 are input to commutation logic block 500 from Time-Based Generator 530. When position (or feedback) based commutation (FBC) is selected, both the hall state and counter values 0-255 are input to commutation logic block 500 from Hall State Decoder Block 515 and Position Estimator Block 510. In an alternative embodiment, commutation logic block 500 may have a selectable input that is based on a register value loaded by firmware. TBC and FBC data may be provided to commutation logic 500 using different channels. Depending on the register value, commutation logic block 500 may accept and use either TBC data or FBC data.

A method of commutating motor 118 based in time, and more particularly using sinusoidal TBC, will now be described in more detail by way of example. In an example embodiment, motor 118 may be a three phase BLDC motor with optional Hall sensors. Generally, commutation of motor 118 may be achieved by applying a dense functional voltage wave shape that corresponds to the back EMF thereof. The dense functional voltage may be defined by a function lookup table stored in memory, such as, for example, lookup table T1 associated with commutation logic block 500 in FIG. 5. Values in the function table may be predetermined (although a continuous function can also be used). Output of commutation logic block 500 using this function table may cause a single ended voltage to develop current in the motor at each rotor position. In an example embodiment, the back EMF function corresponding to the function lookup table T1 is sinusoidal. Therefore, a potential wave shape function can be:

$$\Lambda_U = \begin{cases} 0 & \theta \in \left(0, \frac{2\pi}{3}\right) \\ -\sin\left(\theta + \frac{2\pi}{6} + \phi\right) & \theta \in \left(\frac{2\pi}{3}, \frac{4\pi}{3}\right); \\ \sin(\theta + \pi + \phi) & \theta \in \left(\frac{4\pi}{3}, 2\pi\right) \end{cases}$$

where $A_U$ is the wave shape function for a given winding of motor 118, θ is the electrical rotor position, and ϕ is the phase between a known position and the back EMF wave.

First, an initialization process occurs to set the initial rotor position. If the motor 118 has Hall sensors, as described above, the sensors can be used to determine the position phase ϕ by comparing the Hall state data corresponding to actual motor positions sensed by the Hall sensors and the back EMF wave. Otherwise, a particular motor winding can be energized and assume the motor 118 has reached an equilibrium point after a period based on the inertia and the energization amplitude and function. Controller 102 is then input a period to commutate motor 118 and a commanded voltage level to drive same. The instantaneous normalized wave shape function for each phase is multiplied by voltage level and output to motor 118. The rotor position is then linearly extrapolated based on the commanded period of the electrical commutation rate, the density of the wave shape function, and the last rotor position. For example, the following formula may be used to determine the rotor position:

$$\theta_{new} = \theta_{old} + \frac{t_{Actual}}{T_{CMD}} \frac{m \cdot 2 \cdot \pi}{6};$$

where $\theta_{new}$ is the estimated new rotor position, $\theta_{old}$ is the estimated old rotor position, $t_{Actual}$ is the time that passed since the last conceptual hall state, $T_{CMD}$ is the desired period to commutate the motor, and m is the conceptual, sequential hall state m=[0,1,2,3,4,5]. At each $T_{Actual}=T_{CMD}$, m is incremented or decremented based on direction, and $\theta_{old}$ is assigned the value of $\theta_{new}$. As the approximate rotor position begins to advance, the output voltage command for each phase advances as well, causing motor 118 to generate torque. According to an example embodiment, the particular implementation may use a function table of 256 elements per phase per electrical cycle, but this can vary from coarse to continuous. Also, the motor driver used in this implementation may be single ended (i.e., can only supply or sink between the supply voltage rail and ground) and may be pulse width modulated. In other alternative embodiments, the wave shape function can also be changed.

Figure 6:
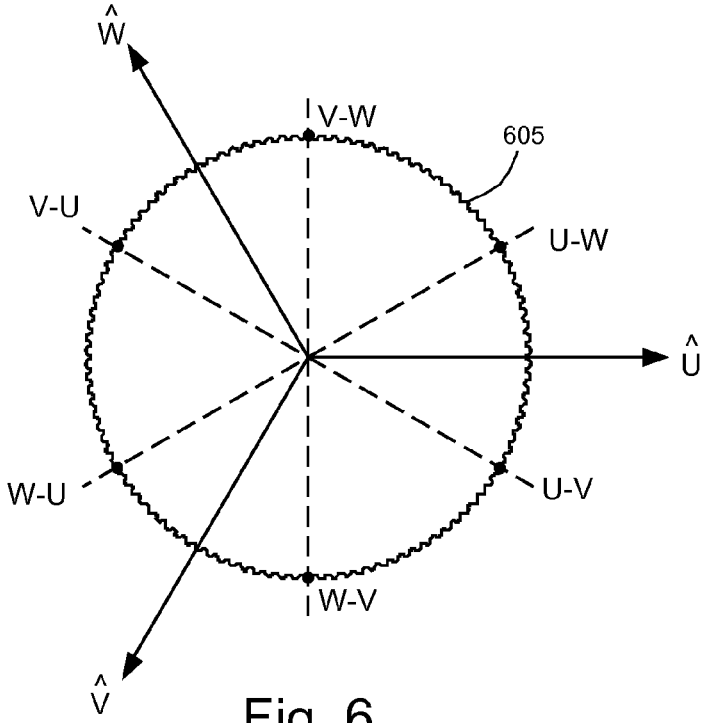
FIG. 6 is a vector diagram illustrating motor command vectors associated with the control system of FIG. 4.

In the above example embodiments, using a dense or continuous function results in very small changes in the command vector. FIG. 6 illustrates a current vector diagram comparing the command vectors used in the system described in U.S. Pat. No. 7,205,738 and the method performed according to the above example embodiments. As shown, u, v, and w are the current vector directions; and u-w, v-w, v-u, w-u, w-v, and u-v are the command vectors corresponding to the six states outlined in U.S. Pat. No. 7,205,738. As can be seen, the command vectors u-w, v-w, v-u, w-u, w-v, and u-v change every 60° of a cycle at each of the six states. On the other hand, current vector 605 used in the above example embodiments is substantially continuous due to small angular differences between commanded vectors, thereby reducing electrical and mechanical ringing and resulting in reduced acoustic and electrical noise emission of motor 118 and, consequently, more quiet motor operations.

Figure 7:
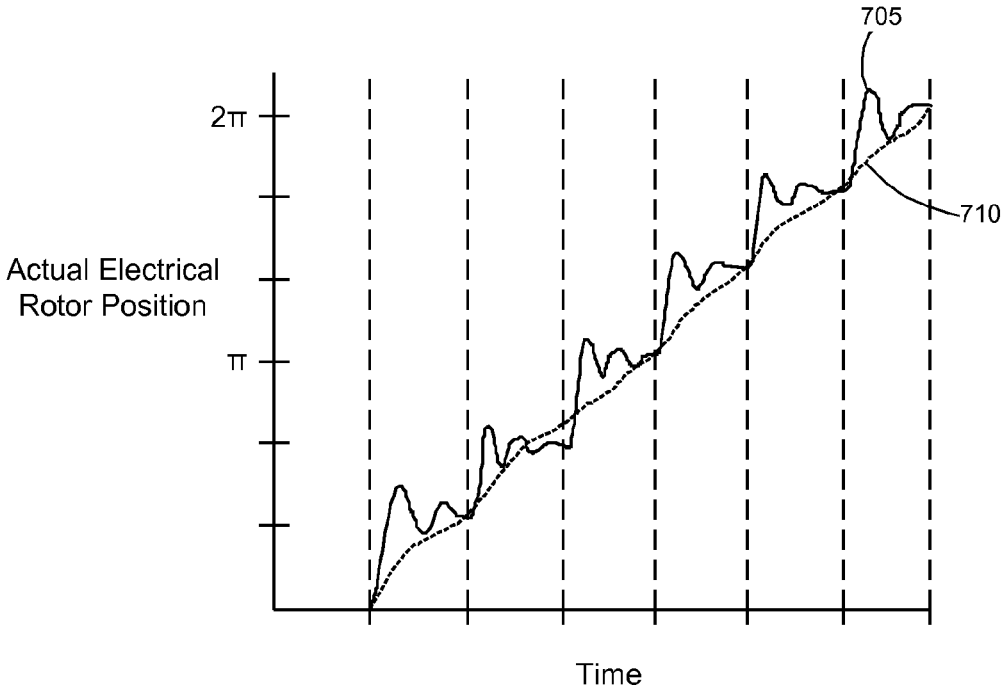
FIG. 7 is a graph showing relative position of a rotor with respect to time corresponding to the control system of FIG. 4.

In FIG. 7, two generally overlying curves 705, 710 are given. Solid curve 705 represents rotor positions versus time as steps are taken during commutation using the system described in U.S. Pat. No. 7,205,738. As demonstrated by solid curve 705, the system yields a chattering effect. Using the above example embodiments, this chattering effect of the rotor is substantially removed as illustrated by the relatively smooth curve 710.

Figure 8:
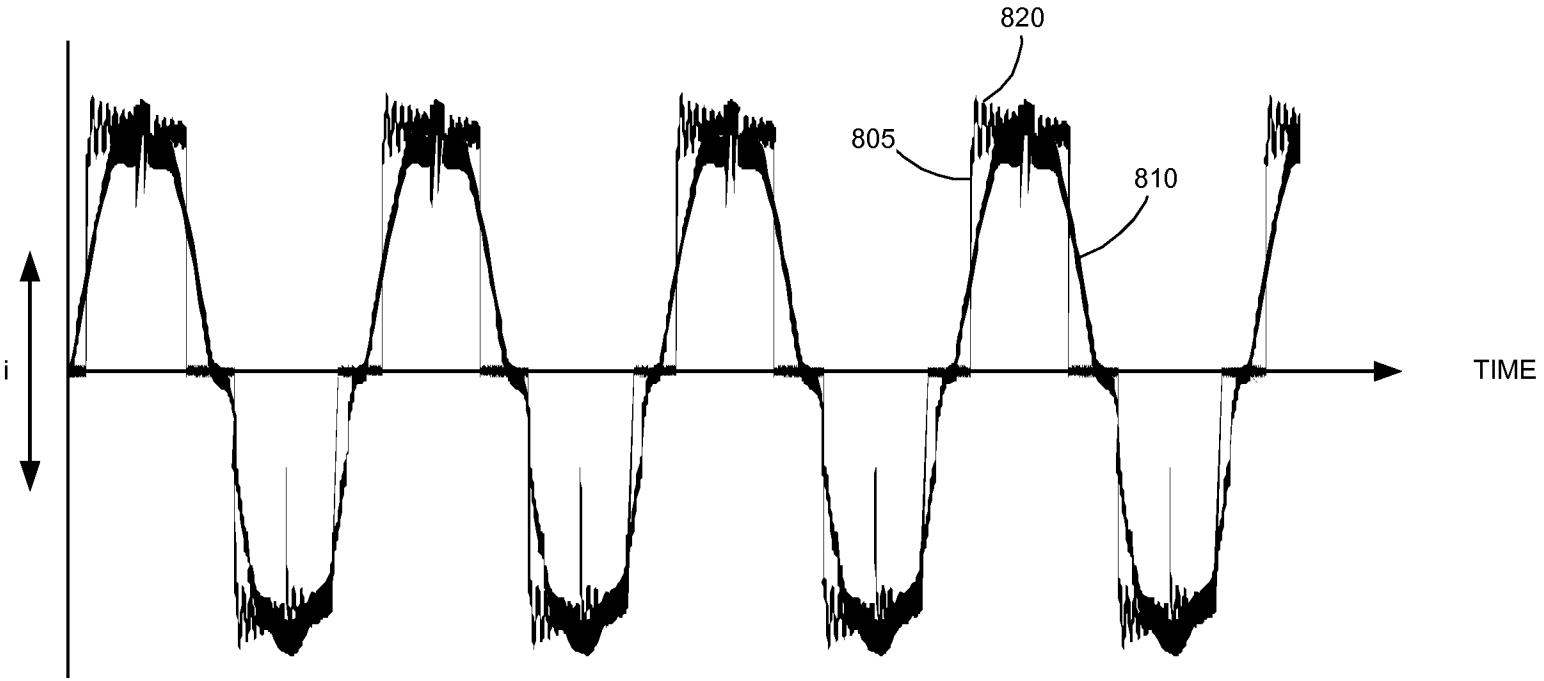
FIG. 8 is a graph illustrating current waveforms in a winding of a motor corresponding to the control system of FIG. 4.

FIG. 8 shows overlaid current waveforms for a given winding of motor 118 which produce the graphs of FIG. 7. Waveform 805 corresponds to a current waveform driven by the scheme described in U.S. Pat. No. 7,205,738 at a commanded speed of, for example, 10 rpm, while waveform 810 corresponds to the current waveform when using the above example embodiments at the same commanded speed. As shown, for a non-optimized sinusoidal shape function, waveform 810 has a relatively smooth shape compared to waveform 805 having markedly sharp transitions or edges occurring at the zero-crossings and at the peaks. Of further note is the ripple 820 in the current waveform 805 from oscillations in rotor position as each equilibrium point is reached, which is not demonstrated in waveform 810.

Commutating motor 118 using sinusoidal TBC thus provides a sensor-less design with benefits of increased efficiency and mechanical output of motor 118, and smooth and quiet motor operation at very low speeds.

Figure 9:
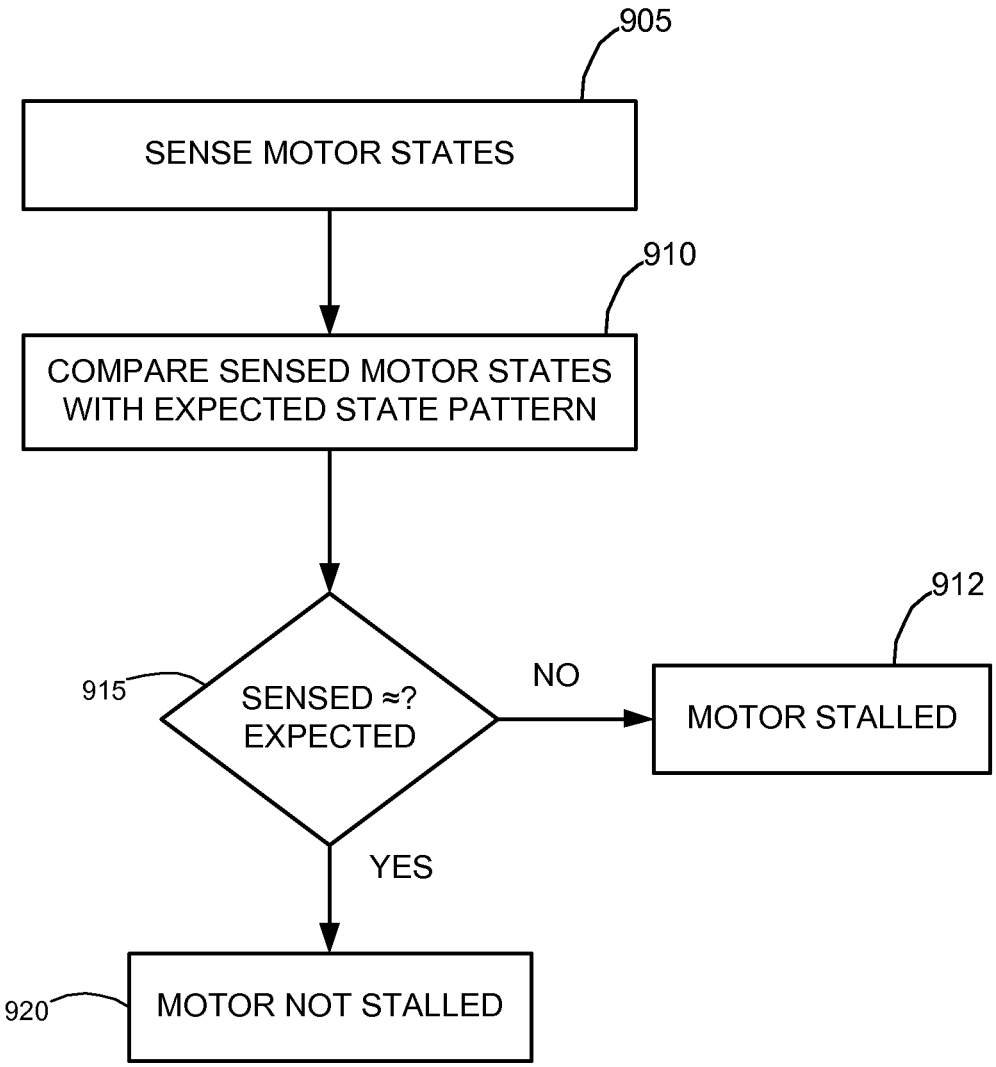
FIG. 9 is a flowchart illustrating a method of detecting a stall condition according to an example embodiment.

Although positional feedback from sensing arrangement 302 is not utilized to commutate motor 118 during sinusoidal TBC motor control, such positional feedback may still be used to detect if motor 118 is still moving. FIG. 9 shows a flowchart illustrating an example method of detecting a stall condition of motor 118 by controller 102 using positional feedback from sensing arrangement 302 while in sinusoidal TBC mode.

At 905, every Hall state of motor 118 is sensed and kept track of as motor 118 turns using sensing arrangement 302. The Hall feedback states may be recorded in memory of controller 102 and each Hall state may need to be present within a certain time period. A time-out period may be set by controller 102 based on the motor speed. Since the expected Hall state pattern is known, the sensed actual Hall states may be compared to the expected Hall state pattern at 910. At 915, a determination is made whether or not the sensed Hall states correspond to the expected Hall state pattern. A positive determination at 920 may indicate that motor 118 has not stalled and is operating normally, as expected. A negative determination, however, may indicate a motor stall condition at 912.

If a motor stall is detected, controller 102 may be configured to control imaging device 100 to respond in a number of ways. In one example, controller 102 may control imaging device 100 to declare a paper jam to the device user. In another example, the above-described standby mode may be aborted without declaring paper jam, and imaging device 100 may enter a different standby state or sleep mode not requiring motor motion. In another example, the duty cycle for the motor drive signals for motor 118 may be boosted. That is, the duty cycle may be increased for a short period of time to get the gear trains and rollers in the drive gear train to push through and overcome friction in the mechanical components. The period of time may correspond to the angular distance of a flat in backup roll 204. The increase in duty cycle may be selected to be large enough to push through the higher friction but not enough to overheat the system in the small amount of time the increased duty cycle was applied. After the boost time period, the duty cycle may revert to a continuous operation level to avoid overheating of motor 118 and other electric driver components. In yet another example, if the stall detection algorithm executed by controller 102 flags a stall, the stall detection can be interpreted by controller 102 as an over-temperature condition of the Hall sensors instead of a stall caused by friction. In response, imaging device 100 may be controlled by controller 102 to wait a certain amount of time to cool off before activating the standby mode again in which motor 118 is rotated at the relatively slow speed. In other examples, stall detection may help ensure that backup roll 204 of fuser assembly 200 is actually rotating and thereby prevent localized heating on backup roll 204 which may otherwise cause damage if not detected.

In some cases, the Hall sensors may fail to switch due to high heat in the ambient air around motor 118. For example, during travel of one North/South pole pair of the rotor of motor 118, one of the Hall states may not be provided due to a thermally failing Hall sensor. To compensate for this, the stall detection algorithm described above may wait for more than one North/South pole pair of motor 118 to travel and produce the six Hall states before making the comparison at 910. Once all the Hall states associated with a North/South pole pair is recognized by controller 102, the comparison can be performed. Thereafter, a register may be reset and the Hall state may begin recording again in a cycle at 905.

In other example embodiments, PWM duty cycles may be adjusted in order to compensate for driver input voltage variations. For a constant duty cycle, the current through the motor 118 is a function of the motor winding resistance and the voltage applied to the motor windings during the PWM cycle. As the voltage goes up, more current flows and as the voltage goes down, less current flows. Therefore, the device voltage may be measured and the duty cycle may be adjusted based on the measured voltage. For example, power supply voltage from voltage/ground source 420 may be fed through a resistor voltage divider and the output sent to an analog to digital converter. The measured voltage may then be used to change the PWM duty cycle. If the voltage is below nominal, the duty cycle is increased. If the voltage is above nominal, the duty cycle is decreased. Stepper motors usually rely on the hardware current limiting and use more current than needed and produce more torque than is needed to overcome the friction torque of the gear train and load. The method according to the example embodiment does not rely on hardware to limit current, but rather the firmware executed by controller 102. By adjusting the PWM duty cycle by measuring nominal voltage, there are two advantages. First, for higher than nominal voltages, the motor 118 will scale the effective voltage back down to nominal and not over use current to overproduce un-needed torque. This saves power and reduces thermal heat. Second, for lower than nominal voltages, the motor 118 will scale the effective voltage up to nominal and not under produce current and torque. This prevents motor stalls.

Relatively apparent advantages of the many embodiments include, but are not limited, running a BLDC motor in stepper (TBC) mode with stall detection which allows fuser assembly 200 to rotate at very slow speeds to meet energy needs but minimize or reduce excessive churn and/or revolutions; combining sinusoidal waveform drive with a stepper mode using a BLDC motor system which ensures smooth rotation to minimize or reduce objectionable acoustic and electrical noises; and providing recovery means for a BLDC motor system when stalls are detected. Advantages also introduce notions of substantially continuously turning backup roll 204 while in standby mode. By doing so, there may not be a need to start and stop motor 118 to achieve effective slow speeds. Also, by substantially constantly turning the gear train of motor 118, there is a continuously applied torque on the fuser gears and backup roll 204 such that no space gaps occur between mechanical components. This eliminates the acoustic noise of mechanical components (such as gear teeth, rollers, or belts) hitting each other periodically during a start, move, stop, and/or pause cycle. Further, because the mechanical components are continuously turning, there is little or no focused compression pressure which may cause flats or permanently compressed areas in backup roll 204 due to high temperature and static pressure. When stopped, the backup roller 204 may be separated from the heat transfer member 202.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An image forming apparatus, comprising:

a fuser assembly including a heat transfer member and a backup member positioned to engage the heat transfer member thereby defining a fusing nip therewith;

a motor coupled to the backup member for rotating the backup member;

a controller coupled to the fuser assembly and the motor, the controller controlling the motor using time-based commutation for a period of time to rotate the backup member at a slower speed relative to a speed for performing a toner fusing operation;

memory having stored therein at least one lookup table having entries which, when sequentially accessed by the controller during the time-based commutation, are used to generate one or more drive signals for the motor to cause current flowing through windings of the motor to have a substantially sinusoidal waveform; and a sensing arrangement associated with the motor for providing to the controller data relating to the motor, wherein during the period of time, the controller is configured to detect a stall condition for the motor based upon the data relating to the motor, wherein the sensing arrangement includes one or more Hall sensors positioned within the motor for producing Hall states indicative of motor position, the controller waiting for one pole pair of a plurality of pole pairs within the motor to produce all associated Hall states prior to detecting the stall condition.

2. The image forming apparatus of claim 1, wherein the motor comprises a brushless DC motor.

3. The image forming apparatus of claim 1, wherein the controller determines a starting entry in the at least one lookup table for the time-based commutation, the starting entry being based on positional feedback from the motor.

4. The image forming apparatus of claim 1, wherein the slower speed is between about 0.4 revolutions per minute (rpm) and about 40 rpm.

5. The image forming apparatus of claim 1, wherein the data provided by the sensing arrangement includes sensed motor positions, the controller detecting the stall condition by comparing the sensed motor positions with expected motor positions.

6. The image forming apparatus of claim 1, wherein upon an affirmative detection of the stall condition, the controller performs at least one of ceasing slow rotation of the backup member, indicating a paper jam condition, and increasing a duty cycle for the one or more drive signals for a predetermined period of time.

7. The image forming apparatus of claim 1, wherein the controller controls the motor using the time-based commutation when the image forming apparatus is in a standby mode and not performing a toner fusing operation.

8. A method of controlling a brushless DC motor in an apparatus, comprising:

storing, in memory, a lookup table having table entries that define extrapolated motor positions;

controlling the motor using time-based commutation according to the table entries of the lookup table, the controlling including:

sequentially selecting the table entries in the lookup table to generate one or more drive signals for the motor; and supplying the one or more drive signals to the motor to cause current flowing through windings thereof to follow a substantially sinusoidal waveform during the time-based commutation; and detecting a stall condition based on positional feedback from the motor, wherein the positional feedback includes data relating to a sensed position of the motor, the detecting the stall condition including comparing the sensed position of the motor and an expected motor position determined based on the table entries in the lookup table.

9. The method of claim 8, further comprising determining a starting entry in the lookup table based on the positional feedback from the motor.

10. The method of claim 8, wherein the positional feedback includes Hall states from one or more Hall sensors positioned within the motor, wherein the detecting the stall condition is not performed until after all Hall states associated with one pole pair of a plurality of pole pairs within the motor are produced.

11. The method of claim 8, wherein upon an affirmative detection of the stall condition, performing at least one of ceasing operation of the motor, indicating a paper jam condition occurring in the apparatus, and increasing a duty cycle for the one or more drive signals for a predetermined period of time.

12. A motor control circuit for controlling a brushless DC motor, comprising:

a controller coupled to the motor for controlling the motor using time-based commutation based on a stored commutation table having entries that define extrapolated motor positions; and a sensing arrangement associated with the motor and coupled to the controller, the sensing arrangement for sensing motor position and providing the sensed motor position to the controller;

wherein the controller detects a stall condition of the motor during the time-based commutation by comparing the sensed motor position with an expected motor position determined based on the entries in the stored commutation table.

13. The motor control circuit of claim 12, wherein the entries in the stored commutation table, when sequentially accessed by the controller during the time-based commutation, generates one or more drive signals for the motor to cause current flowing through windings of the motor to follow a substantially sinusoidal waveform.

14. The motor control circuit of claim 12, wherein the controller selects a starting entry from the stored commutation table based on motor positional feedback provided by the sensing arrangement.

15. The motor control circuit of claim 12, wherein the sensing arrangement includes one or more Hall sensors positioned within the motor for producing Hall states indicative of the sensed motor position, the controller detecting the stall condition when all Hall states associated with one pole pair of a plurality of pole pairs within the motor are recognized by the controller.

16. The motor control circuit of claim 12, wherein upon an affirmative detection of the stall condition, the controller performs at least one of ceasing operation of the motor, indicating a paper jam condition occurring in a device in which the motor control circuit and the motor are disposed, and increasing a duty cycle for one or more drive signals for the motor for a predetermined period of time.

17. The image forming apparatus of claim 1, wherein the controller accesses an entry of the at least one lookup table based upon a counter value that is based on a clock input.

18. A method of controlling a brushless DC motor in an apparatus, comprising:

storing, in memory, a lookup table having table entries that define extrapolated motor positions;

controlling the motor using time-based commutation according to the table entries of the lookup table, the controlling including:

sequentially selecting the table entries in the lookup table to generate one or more drive signals for the motor; and supplying the one or more drive signals to the motor to cause current flowing through windings thereof to follow a substantially sinusoidal waveform during the time-based commutation; and detecting a stall condition based on positional feedback from the motor, wherein the positional feedback includes Hall states from one or more Hall sensors positioned within the motor, wherein the detecting the stall condition is not performed until after all Hall states associated with one pole pair of a plurality of pole pairs within the motor are produced.

19. A method of controlling a brushless DC motor in an apparatus, comprising:

storing, in memory, a lookup table having table entries that define extrapolated motor positions;

controlling the motor using time-based commutation according to the table entries of the lookup table, the controlling including:

sequentially selecting the table entries in the lookup table to generate one or more drive signals for the motor; and supplying the one or more drive signals to the motor to cause current flowing through windings thereof to follow a substantially sinusoidal waveform during the time-based commutation; and detecting a stall condition based on positional feedback from the motor, wherein upon an affirmative detection of the stall condition, performing at least one of ceasing operation of the motor, indicating a paper jam condition occurring in the apparatus, and increasing a duty cycle for the one or more drive signals for a predetermined period of time.

20. The image forming apparatus of claim 1, wherein controller detects the stall condition by comparing the data relating to the motor and an expected motor position determined based on the entries in the at least one lookup table.

21. The image forming apparatus of claim 1, wherein upon an affirmative detection of the stall condition, the controller performs at least one of ceasing operation of the motor, indicating a paper jam condition, and increasing a duty cycle for the one or more drive signals for a predetermined period of time.

* * * * *